US007748969B2

(12) United States Patent
Um

(10) Patent No.: US 7,748,969 B2
(45) Date of Patent: Jul. 6, 2010

(54) FOAM REDUCTION DEVICE FOR A COMPRESSOR

(75) Inventor: Kangw-No Um, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 663 days.

(21) Appl. No.: 11/646,330

(22) Filed: Dec. 28, 2006

(65) Prior Publication Data

US 2007/0183917 A1 Aug. 9, 2007

(30) Foreign Application Priority Data

Dec. 30, 2005 (KR) ..... 10-2005-0136072

(51) Int. Cl.
*F04C 18/00* (2006.01)
*F04C 2/00* (2006.01)

(52) U.S. Cl. ..... 418/55.6; 418/55.1; 418/88; 418/89; 418/94; 418/97; 184/6.16; 184/6.18

(58) Field of Classification Search ..... 418/55.1–55.6, 418/57, 88, 89, 94, 97, 270, DIG. 1; 184/6.16–6.18
See application file for complete search history.

(56) References Cited

U.S. PATENT DOCUMENTS 3,572,008 A * 3/1971 Hankison et al. ..... 210/649
3,731,808 A * 5/1973 Rickert ..... 210/138
5,176,506 A * 1/1993 Siebel ..... 418/89
5,775,120 A 7/1998 Inazuka et al.
5,775,123 A 7/1998 Wakayama et al.
6,182,460 B1 2/2001 Hernandez et al.
6,287,099 B1 9/2001 Chang, II et al.
6,374,492 B1 4/2002 Myung et al.
6,412,298 B2 7/2002 Kang et al.
6,588,228 B2 7/2003 Choi
6,659,735 B2 12/2003 Kim
6,685,441 B2 2/2004 Nam
6,695,600 B2 2/2004 Koo et al.
6,772,601 B1 8/2004 Davis et al.
6,868,681 B2 3/2005 Woo et al.
6,955,064 B2 10/2005 Lee et al.
6,962,058 B2 11/2005 Kim et al.

(Continued)

FOREIGN PATENT DOCUMENTS

JP 01147186 A * 6/1989 ..... 418/55.6

(Continued)

OTHER PUBLICATIONS

Chinese Office Action dated Jun. 20, 2008.

*Primary Examiner*—Theresa Trieu
(74) *Attorney, Agent, or Firm*—Ked & Associates LLP

(57) ABSTRACT

A foam control device includes a first member coupled to an oil reservoir of a compressor and a second member to prevent foam from flowing into an interior section of the compressor. when a shaft of the compressor rotates. The second member controls a position of the first member based on at least one condition which, for example, may include an amount of oil in the reservoir, an environmental condition, or the type of oil or refrigerant used. According to one embodiment, the first member includes a plate containing one or more apertures that allow oil, suctioned from the reservoir, to pass back into the reservoir when the compressor shaft rotates.

23 Claims, 10 Drawing Sheets

U.S. PATENT DOCUMENTS

| | | | |
|---|---|---|---|
| 7,032,404 | B2 | 4/2006 | Kim et al. |
| 7,036,331 | B2 | 5/2006 | Kim |
| 7,055,338 | B2 | 6/2006 | Ergarac et al. |
| 7,082,776 | B2 | 8/2006 | Shin |
| 7,114,345 | B2 | 10/2006 | Kim et al. |
| 7,121,106 | B2 | 10/2006 | Jung et al. |

FOREIGN PATENT DOCUMENTS

| | | | | | |
|---|---|---|---|---|---|
| JP | 02011889 | A | * | 1/1990 | ..... 418/89 |
| JP | 02078785 | A | * | 3/1990 | ..... 418/55.6 |
| JP | 04-347387 | | | 12/1992 | |
| JP | 10-047283 | | | 2/1998 | |

* cited by examiner

FOAM REDUCTION DEVICE FOR A COMPRESSOR

BACKGROUND

1. Field

One or more embodiments described herein relate to compressors.

2. Background

Scroll compressors have been used in air conditioners, refrigerators, and other appliances. In a scroll compressor, two scrolls rotate relative to one another to form a plurality of pressure chambers. As the pressure chambers continuously move in a central direction, suction is created to discharge refrigerant gas. However, in related-art scroll compressors, foam builds up inside the compressor to degrade performance.

BRIEF DESCRIPTION OF THE DRAWINGS

The embodiments will be described in detail with reference to the following drawings, in which like reference numerals refer to like elements.

DETAILED DESCRIPTION

Figure 1:
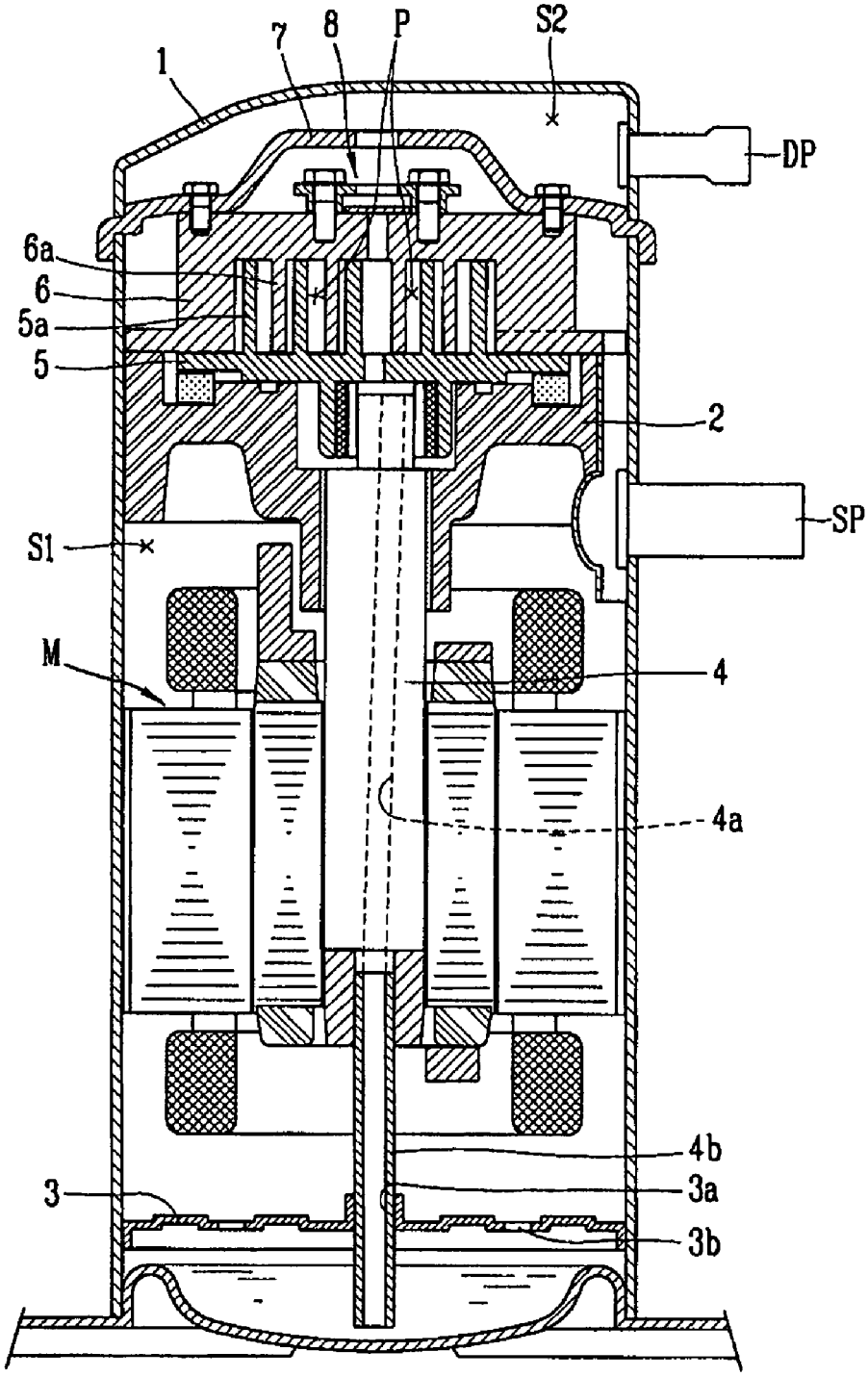
FIG. 1 is a diagram showing a sectional view of one type of scroll compressor.
Figure 2:
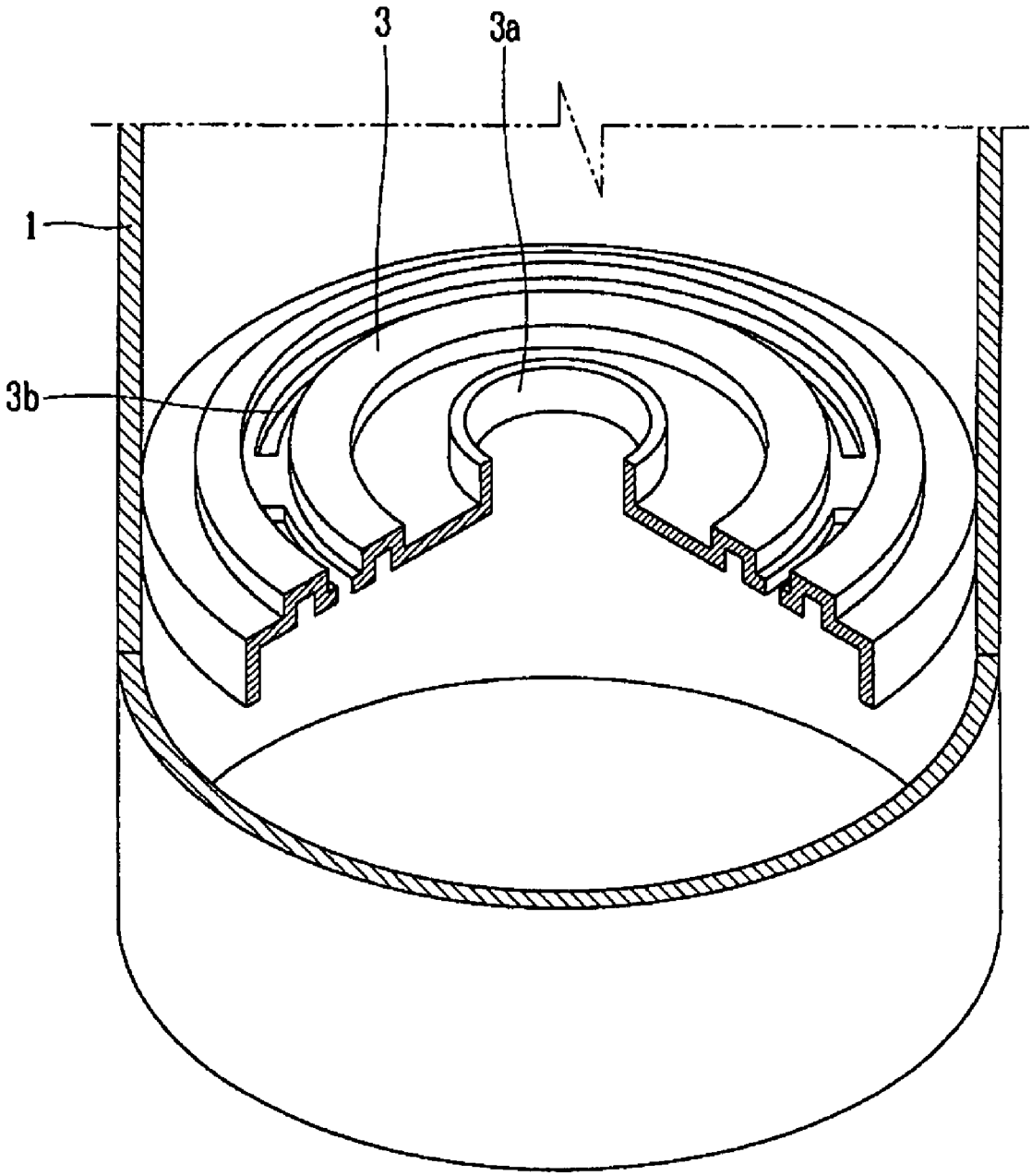
FIG. 2 is a diagram showing a cut away of the compressor of FIG. 1.

FIG. 1 shows one type of scroll compressor which includes a casing 1, a main frame 2, a sub-frame 3, a motor (M), a shaft 4, a rotating scroll 5, a fixing scroll 6, a high/low pressure partition plate 7, and a check valve 8. An airtight internal space of the casing is divided into a suction area (S1) and a discharge area (S2). A gas suction pipe (SP) is installed in the suction area and a gas discharge pipe (DP) is installed in the discharge area.

The main frame 2 and sub-frame 3 are fixed to upper and lower circumferential surfaces of the casing. The motor is mounted between the main frame and sub-frame and shaft 4 transmits rotational force to the rotor of the motor.

The rotating scroll is mounted on the main frame and is fastened to the shaft. The fixing scroll has a fixing lap 6*a* of a spiral shape fixed to an upper surface of the main frame, such that the fixing lap engages rotating lap 5*a* of the rotating scroll to form a plurality of pressure chambers (P). The high/low pressure partition plate 7 is fastened to a rear surface of the fixing scroll to partition an internal space of the casing into the suction area and discharge area. The check valve 8 is connected to a rear surface of a light plate configured in fixing scroll 6 to prevent gas discharged into outlet space (S2) from back flowing.

The sub-frame 3 is welded to an inner circumferential surface of the casing in a circular plate shape. The sub-frame has a hole 3*a* to support a lower portion of the shaft in a radial direction, or to support an oil inlet pipe 4*b* inserted in an oil path 4*a* of the shaft in a radial direction.

Also, a plurality of oil through-holes 3*b* are formed on the sub-frame in a circular arc shape with respect to oil drawn through oil path 4*a* of the shaft. The through-holes drop the oil drawn through oil path 4*a* of the shaft to a bottom reservoir of the casing.

In operation, once power is applied to the motor, shaft 4 rotates with the rotor of the motor to transmit rotational force to the rotating scroll 5. The rotating scroll rotates to form pressure chambers (P), which continuously move, between rotating lap 5*a* and fixing lap 6*a*. The pressure chambers are moved to a center by the continuous rotational movement of the rotating scroll to thereby reduce volume and compress refrigerant gas.

An oil feeder (not shown) or oil suction pipe 4*b* may be provided at a lower end of shaft 4, and the oil remaining in the lower end of the casing is drawn through the oil feeder or oil suction pipe 4*b* to lubricate each sliding part before returning to the casing through the oil through-hole 3*b*. During that process, the oil feeder or oil suction pipe 4*b* may stir the oil within the casing to generate foam.

Figure 3:
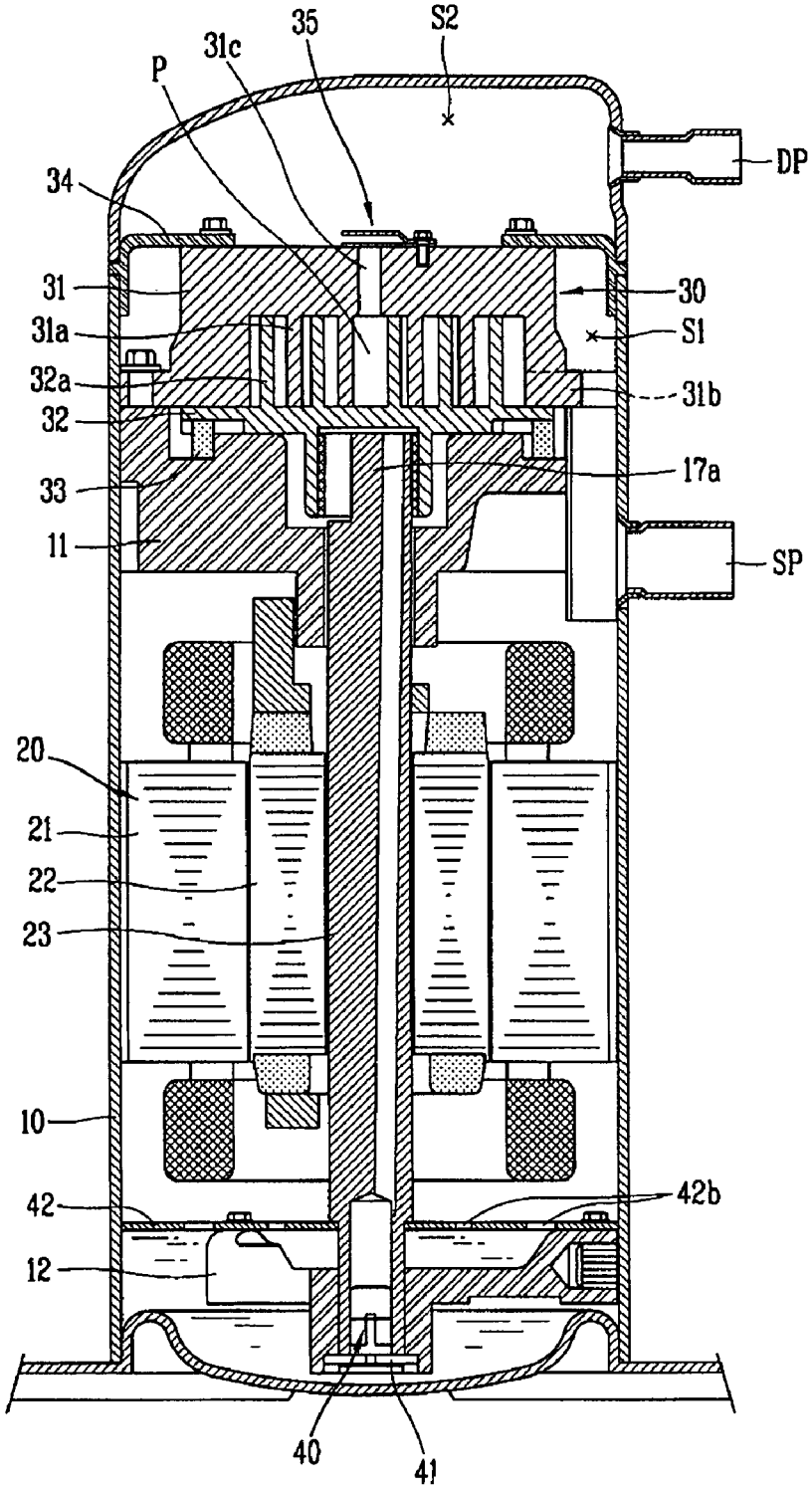
FIG. 3 is a diagram showing a sectional view of another type of scroll compressor.
Figure 4:
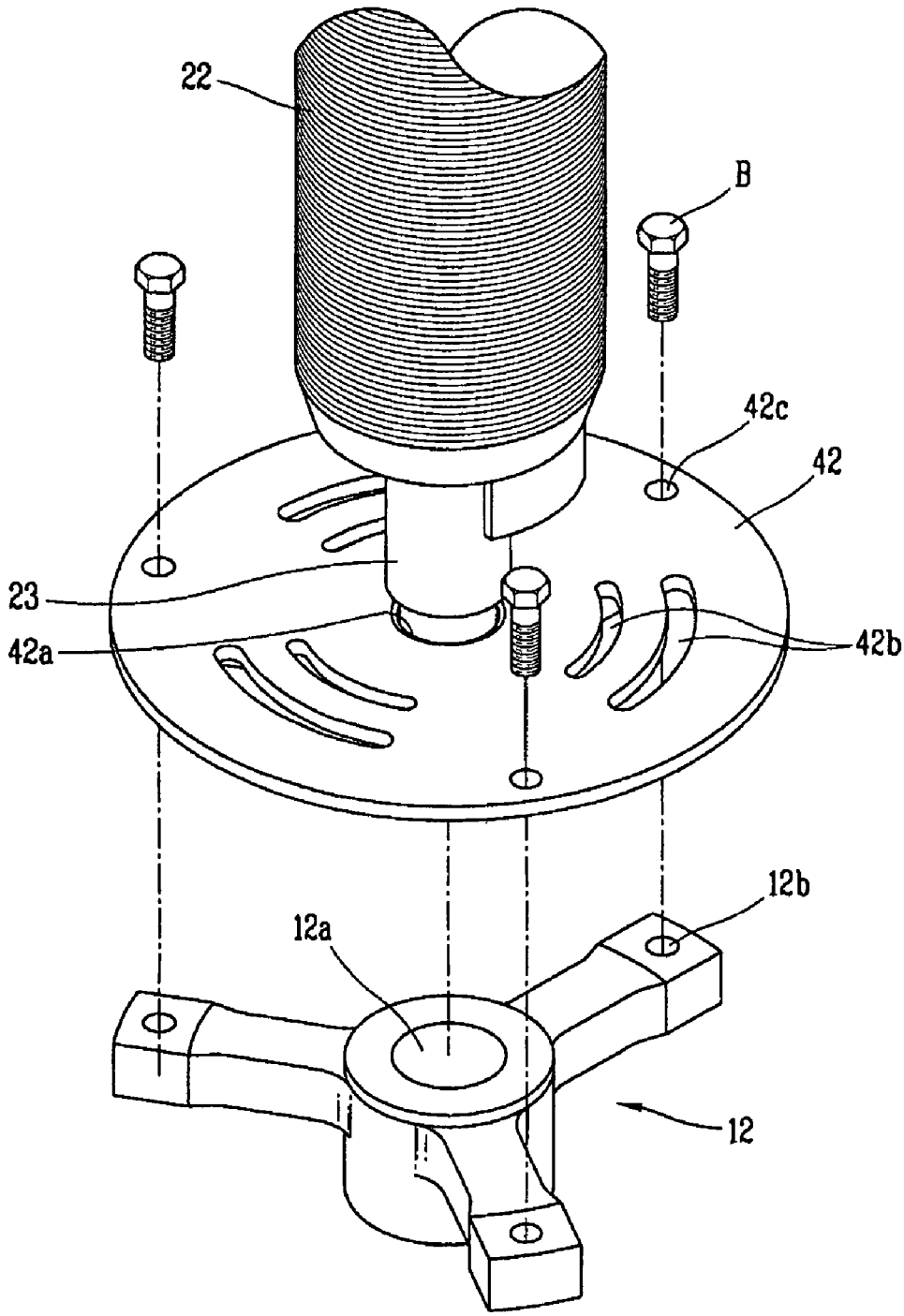
FIG. 4 is a diagram showing a cut away of the scroll compressor of FIG. 3.
Figure 5:
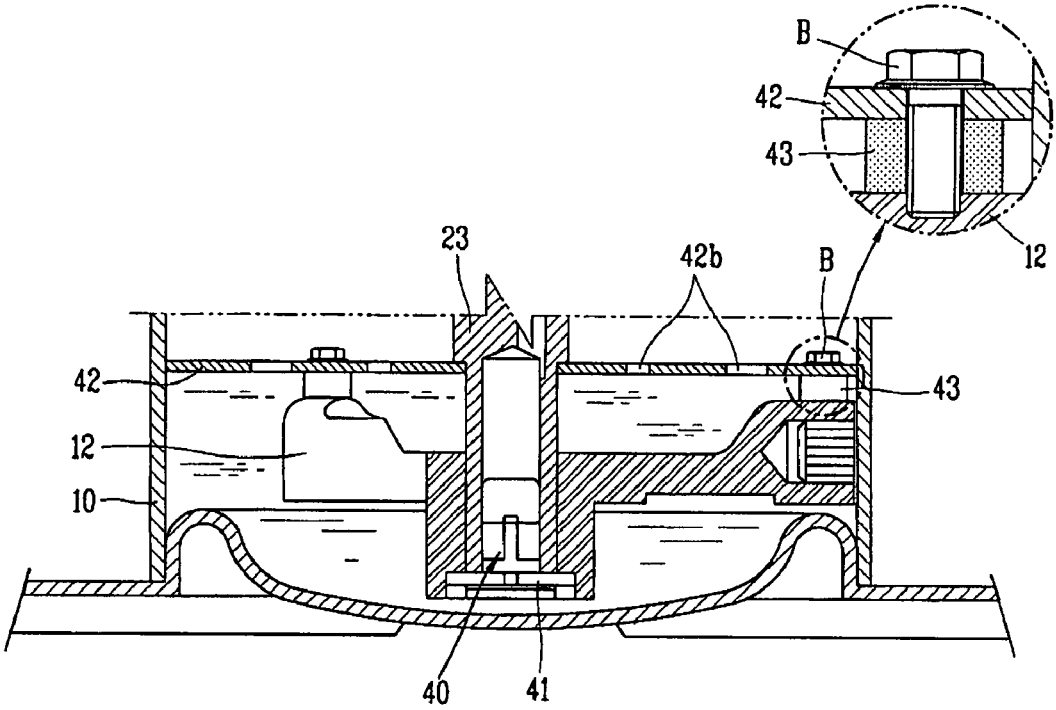
FIG. 5 is a diagram showing an example of a foam reduction device that may be included in the scroll compressor of FIG. 3.

FIG. 3 shows another type of scroll compressor, FIG. 4 shows a sub-bearing and foam shut-off plate that may be included in the scroll compressor of FIG. 3, and FIG. 5 shows an example of a foam reduction device that may be included in the scroll compressor of FIG. 3.

As shown in FIGS. 3 to 5, a scroll compressor having a foam reduction device includes a casing 10, a motor 20, a compression part 30 and an oil supply part 40. The casing is formed airtight to hold a predetermined amount of oil. The motor is mounted within the casing to generate rotational force. The compression part receives the rotational force from the motor to form one or more pressure chambers (P) between two scrolls. And, oil supply part 40 pumps the oil from a reservoir of the casing to supply it to the compression part.

The airtight internal space of the casing is divided into a suction area (S1) and a discharge area (S2) by a high/low pressure partition plate 34. A refrigerant suction pipe (SP) is installed in the suction space (S1) and a refrigerant discharge pipe (DP) is installed in the discharge space (S2). Main frame 11 and sub-frame 12 are fixed to opposite sides of the motor mounted within the suction area of the casing.

The motor includes a stator 21 and a rotor 22, the latter of which is coupled to a shaft 23. The stator is fixed within the casing and the rotor is provided within the stator in a predetermined air gap to rotate due to mutual action with the stator. The shaft is fastened to the rotor to transmit rotational force of the motor to the compression part.

The compression part includes a fixing scroll 31, a rotating scroll 32, an Oldham's ring 33, high/low pressure partition plate 34, and a check valve 35. The fixing scroll is fixed to an upper surface of main frame 11 and forms a fixing lap 31*a* of a spiral shape on a down surface of its light plate. The rotating scroll is rotatably mounted on an upper surface of the main frame to form a rotating lap 32*a* of a spiral shape and the rotating scroll engages the fixing scroll to form a plurality of pressure chambers (P). The Oldham's ring is installed between the rotating scroll and main frame to rotate the rotating scroll, to thereby prevent the rotating scroll from rotating on its own axis. The high/low pressure partition plate 34 is installed on a rear surface of the light plate provided in the fixing scroll 31. The check valve closes an outlet 31*c* of the fixing scroll 31 to prevent the discharged gas from back flowing.

The oil supply part 40 includes an oil feeder 41, a foam shut-off plate 42, and an interval maintenance member 43. The oil feeder is installed at a low end of the shaft 23 to rotate together with the shaft so that the oil feeder pumps the oil of the casing. The foam shut-off plate is fixed to a side of the sub-frame 12 to shut-off oil of the casing from foamingly rising to the surface of oil. The interval maintenance member 43 is disposed between the sub-frame and foam shut-off plate 42 to vary the height of the foam shut-off plate based on the variation of the oil amount collected within the casing, and/or one or more environmental conditions, and/or a type of oil or refrigerant in the compressor.

The foam shut-off plate may be formed in a circular shape having a through-hole 42*a* through which shaft 23 of the motor passes. Oil through-holes 42*b* are formed adjacent through-hole 42*a* so that the lubricated oil or the oil drawn/separated through the gas suction pipe (SP) may flow through oil through-holes 42*b*. Also, a plurality of fastening holes 42*c*, corresponding to fastening recesses 12*b* of sub-frame 12, are formed near oil through-holes 42*b* to be fastened by bolts (B).

As shown in FIG. 4, the foam shut-off plate may be installed on an upper surface of the sub-frame 12 because the amount of oil can vary, for example, based on the type of oil or kind of refrigerant drawn into the casing or based on environmental changes of an air conditioner having the scroll compressor. Although not shown in the drawings, foam shut-off plate 42 may alternatively be installed on a lower surface of the sub-frame.

Figure 6:
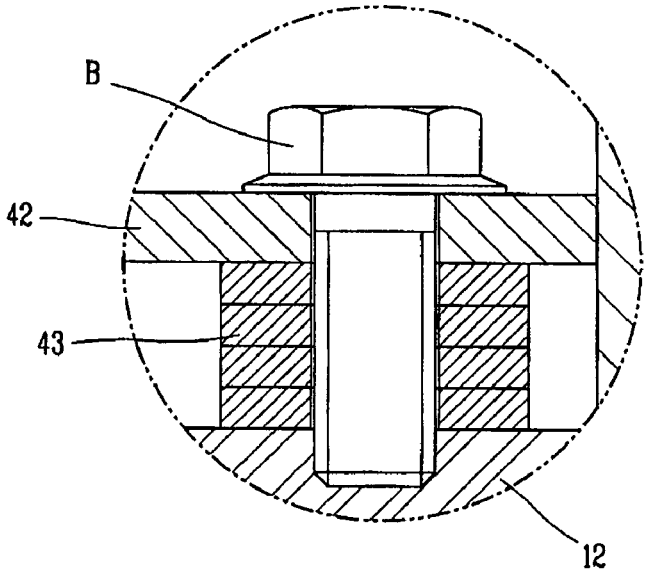
FIGS. 6 and 7 are diagrams showing sectional views of an interval maintaining member that be included in the foam reduction device of FIG. 5.

Interval maintenance member 43 may be formed in one piece as shown in FIG. 5, or may be formed from a plurality of layered metal sheets as shown in FIG. 6 to adjust the height of the foam shut-off plate more precisely. In the latter case, each metal sheet of the interval maintenance member may be separately arranged or formed in a circular shape.

Figure 7:
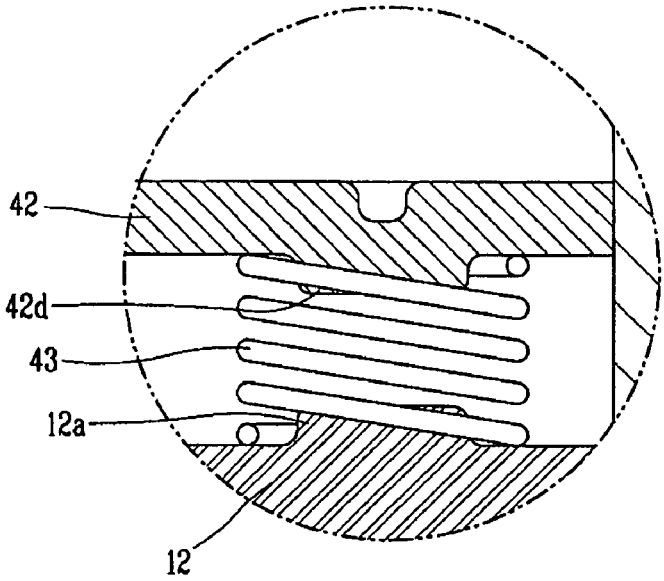

Further, as shown in FIG. 7, the interval maintenance member may be an elastic member, e.g., a compression coil spring. If so, fastening protrusions 12*a* and 42*d* may be formed between and in contact with sub-frame 12 and foam shut-off plate 42 to allow for insertion of the compression coil spring.

Also, the interval maintenance member may be made of metal to be welded or fixed by a bolt. Alternatively, the interval maintenance member may be made from molded plastic to be fixed to the sub-frame by a bolt. Considering production costs, it may be preferable in some instances to make the interval maintenance member from plastic.

Figure 8:
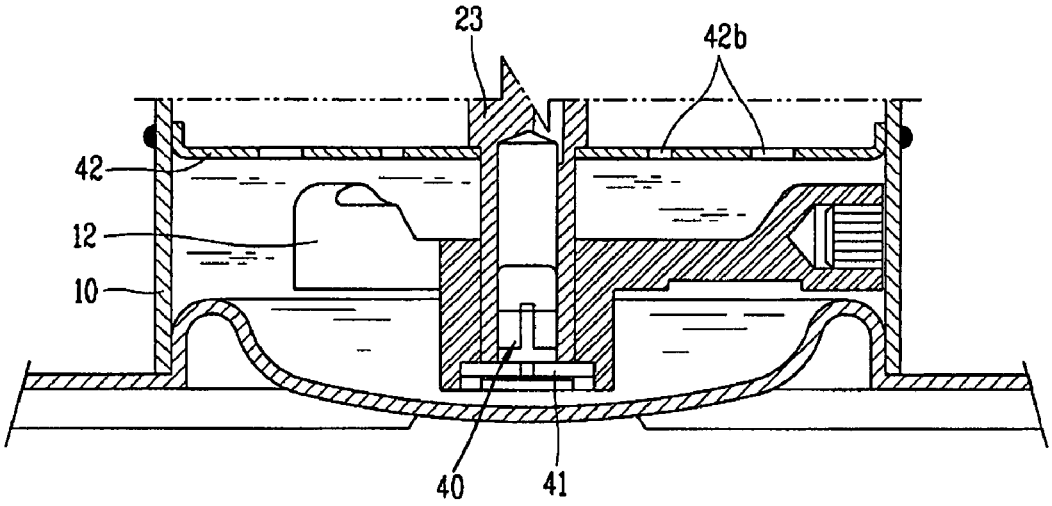
FIG. 8 is a diagram showing a sectional view of another embodiment of a foam shut-off plate that may be included in the scroll compressor of FIG. 3.

As shown in FIG. 8, the appropriate height of the foam shut-off plate may be adjusted and the foam shut-off plate may be fastened to an inner circumferential surface of casing 10, separate from sub-frame 12. In this case, the foam shut-off plate may be made of metal so that it can be welded to the casing. Alternatively, an auxiliary fixing member 44 may be welded to the casing and the foam shut-off plate may be made of non-metal material such as plastic to be fastened to fixing member 44.

In the case where the foam shut-off plate is assembled to fixing member 44, interval maintenance member 43 may be formed in one piece (e.g., to have a unitary construction) and a plurality of metal sheets or an elastic member may be provided between the foam shut-off plate and the fixing member. In addition to these features, it is noted that reference numeral 12*a* corresponds to a bearing hole, reference numeral 23*a* identifies an oil path, and reference numeral 31*b* identifies an inlet.

The scroll compressor described herein may therefore include a foam reduction device which can vary the height of a foam shut-off plate based on the variable amount of oil within a casing according, for example, to surrounding changes of air conditions and/or the type of oil or refrigerant used. Structurally, in accordance with one embodiment, the foam reduction device may include a casing that holds a predetermined amount of oil, a plurality of frames fixed to opposite sides of the casing, a shaft supported by the frame in a radial direction to transmit rotational force of a motor to a rotating scroll such that the rotating scroll is engaged with a fixing scroll to form one or more pressure chambers, and with the shaft suctioning oil to be supplied to sliding parts, and a foam shut-off plate installed on an upper or lower portion one frame installed in a lower half portion of the casing to shut-off foams generated when the shaft rotates.

Descriptions of scroll compressors and the operation thereof may be found, for example, in U.S. Pat. Nos. 6,695,600, 6,685,441, 6,659,735, and 6,287,099, the contents of which are incorporated herein by reference and which are subject to an obligation of assignment to the same entity.

Although the embodiments described herein relate to scroll compressors for ease of discussion, it is understood that an oil pump as embodied and broadly described herein may be applied to other types of compressors and/or other applications which require fluid pumping. These other types of compressors include but are not limited to different types of scroll compressors, reciprocating compressors, centrifugal compressors, and vane-type compressors.

Figure 9:
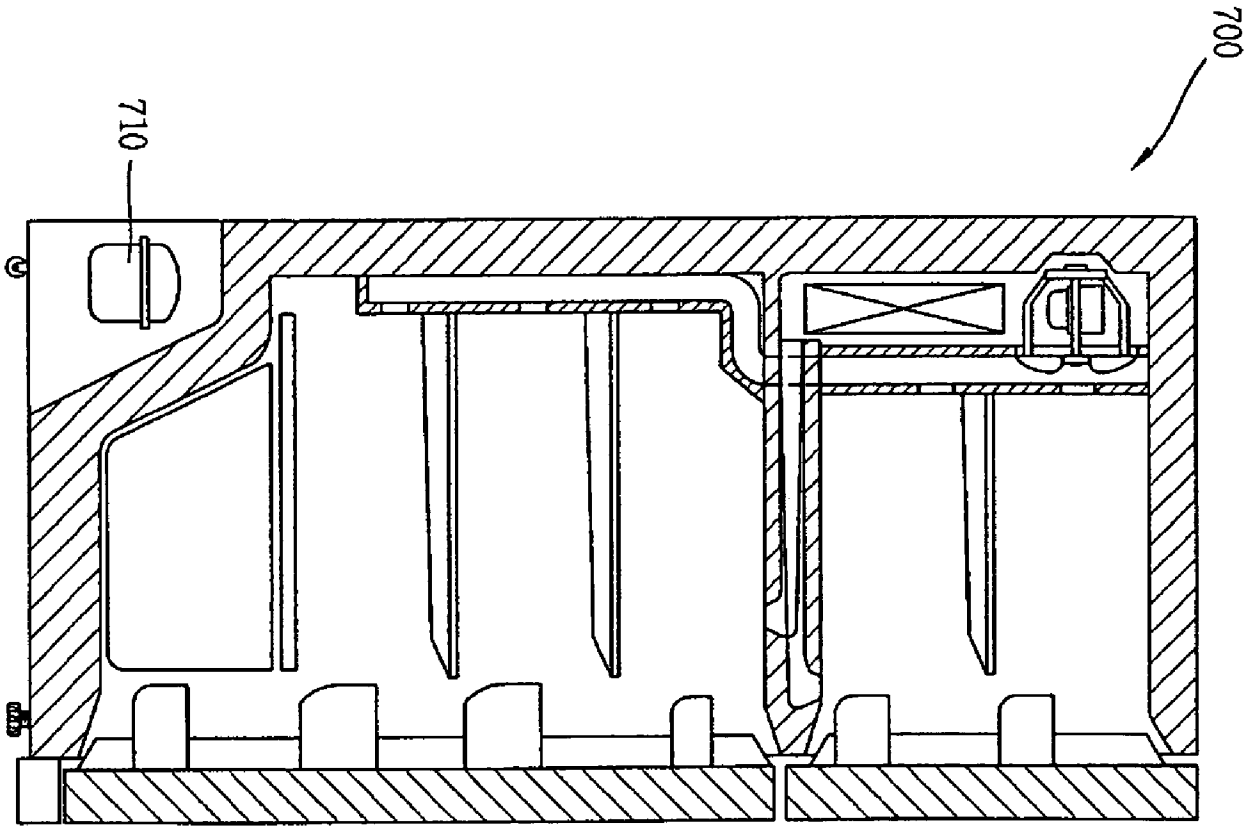
FIGS. 9, 10, and 11 are diagrams showing exemplary installations of a compressor which may include any of the embodiments of the foam reduction device embodied and broadly described herein.

Moreover, a compressor containing the foam reduction device described herein may have numerous applications in which compression of fluids is required. Such applications may include, for example, air conditioning or refrigeration applications. One such exemplary application is shown in FIG. 9, in which a compressor 710 having an oil pump as described herein is installed in a refrigerator/freezer 700. The installation and functionality of a compressor when embodied within a refrigerator is discussed in detail in U.S. Pat. Nos. 7,082,776, 6,955,064, 7,114,345, 7,055,338, and 6,772,601, the entirety of which are incorporated herein by reference.

Figure 10:
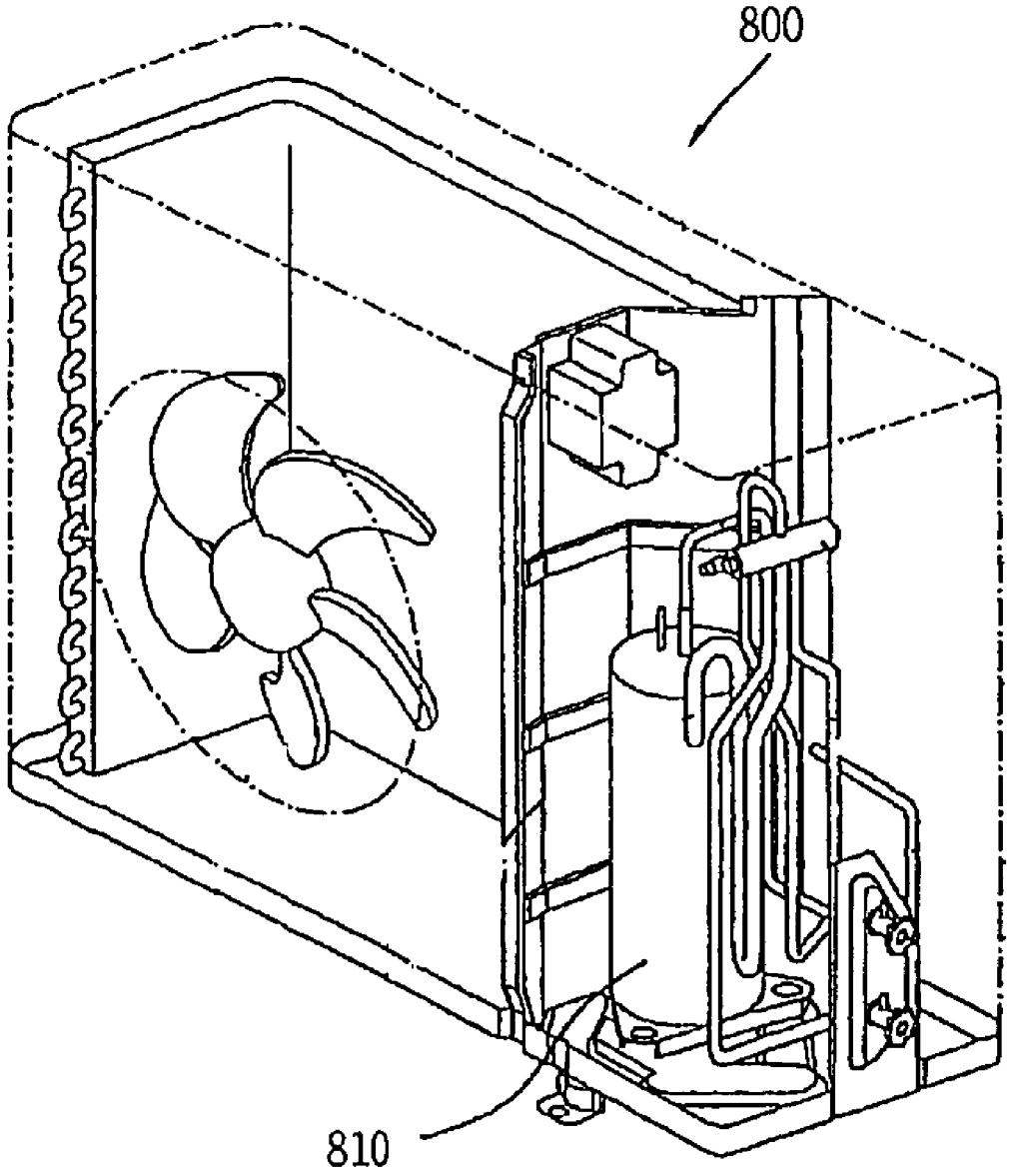

Another exemplary application is shown in FIG. 10, in which a compressor 810 having an oil pumping assembly as described herein is installed in an outdoor unit of an air conditioner 800. The installation and functionality of a compressor when embodied within an outdoor unit of air conditioner is discussed in detail in U.S. Pat. Nos. 7,121,106, 6,868,681, 5,775,120, 6,374,492, 6,962,058, 6,951,628, and 5,947,373, the entirety of which are incorporated herein by reference.

Figure 11:
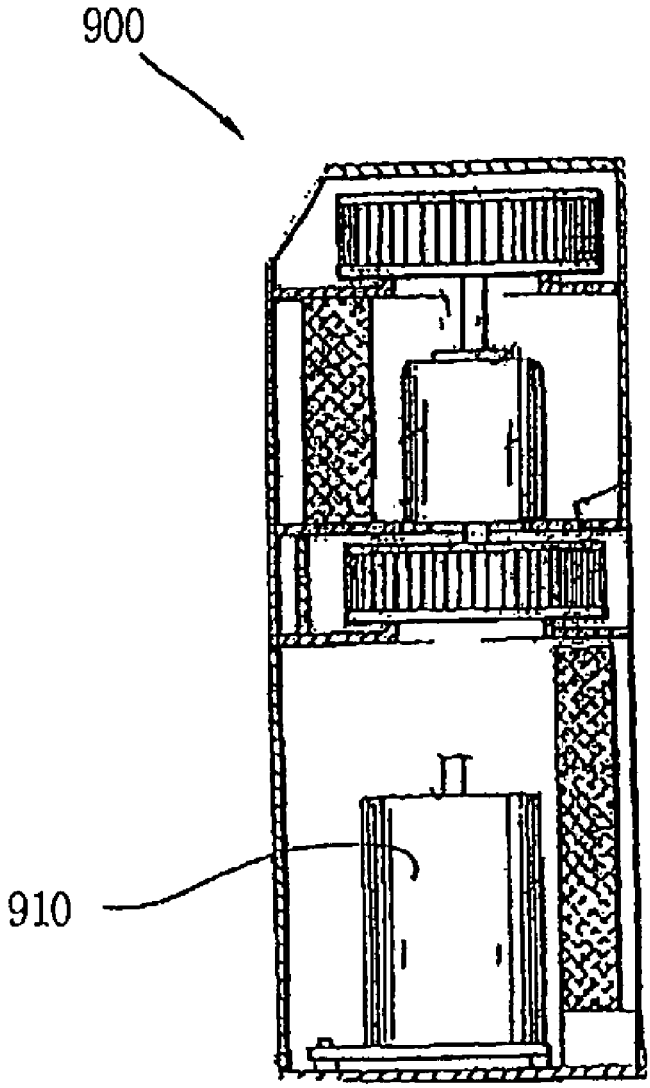
Figure 12:
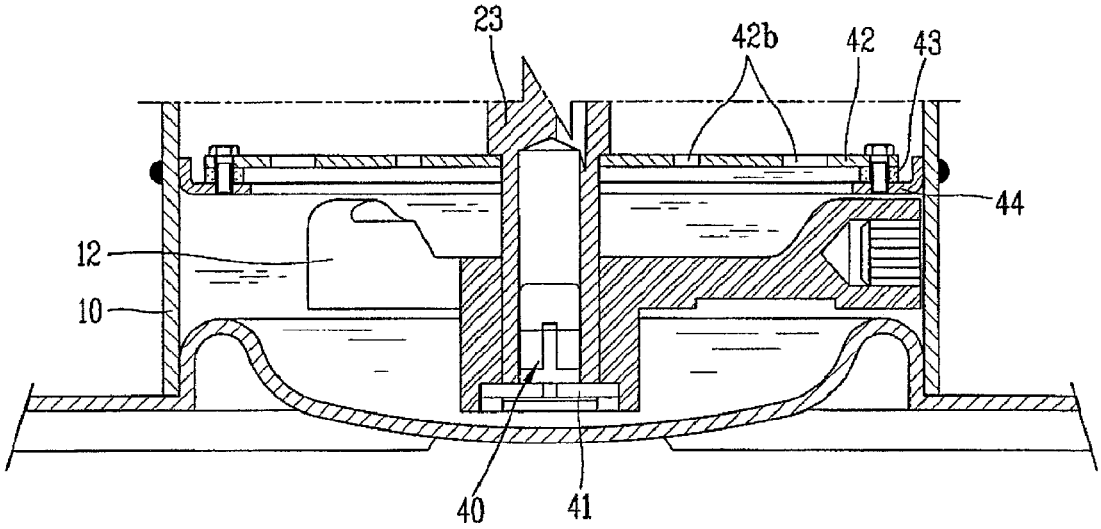
FIG. 12 is a diagram showing an auxiliary fixing member that may be included in one or more embodiments discloses herein

Another application of the compressor containing an oil pump as described herein relates to an integrated air conditioning unit. As shown in FIG. 11, this application includes a compressor 910 having an oil pump as described herein is installed in a single, integrated air conditioning unit 900. The installation and functionality of a compressor when embodied within an outdoor unit of air conditioner is discussed in detail in U.S. Pat. Nos. 7,036,331, 7,032,404, 6,588,228, 6,412,298, 6,182,460, and 5,775,123, the entirety of which are incorporated herein by reference.

The foam reduction device of the compressor described herein may therefore have one or more of the following advantageous effects.

First, as shaft 23 rotates by power applied to motor 20, rotating scroll 32 rotates an eccentric distance. Hence, pressure chambers (P) formed between rotating lap 32*a* of rotating scroll 32 and fixing lap 31*a* of fixing scroll 31 continuously move. The pressure chambers (P) move to a center position by the continuous rotation of rotating scroll 32. As a result, the volumes of the pressure chambers (P) are reduced to compress refrigerant gas.

When shaft 23 sunk into the oil rotates, the oil held in a lower portion of the casing 10 is sucked up along oil path 23*a* of the shaft to lubricate one or more moving or sliding parts. Hence, the oil passing through the oil through-holes 42*b* is dropped to a bottom (reservoir) of the casing. The shaft, or alternatively an oil feeder or an oil suction pipe, stirs the oil to generate foam. The foam tries to rise up toward compression parts 30 but is stopped from rising by the foam shut-off plate 42.

Thus, safety of an oil surface is enhanced and oil is prevented from being sucked into the pressure chambers and being mixed with refrigerant. Also, since the surface of oil remains calm to thereby maintain the amount of oil suction and to prevent alternation with the rotor, the efficiency of the compressor may be enhanced.

Next, when the scroll compressor is adapted to an air conditioner or other appliance, the surroundings of the air conditioner may be changed or the amount of oil may be changed by the kind of refrigerant or oil. Thus, although the sub-frame is installed in an optimal position to support the shaft, the position of the foam shut-off plate may be adjustable according to the oil suction amount. Thus, there is another advantageous effect of foam shut-off.

Also, the foam shut-off plate is fixed to the casing, separate from the sub-frame and the foam shut-off plate is installed at an optimal position based on the oil amount of the sub-frame. This results in another advantageous effect of shutting off the foam completely.

Also, since the foam shut-off plate can be made of various materials, the foam shut-off plate is not difficult to fabricate and production costs can therefore be lowered. Since the elastic member is installed between the foam shut-off plate and the sub-frame, or alternatively the auxiliary fixing member, noise generated by vibration transmitted from foam can be reduced.

Any reference in this specification to "one embodiment," "an exemplary," "example embodiment," "certain embodiment," "alternative embodiment," and the like means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A foam control device for a compressor, comprising:

a first member coupled to an oil reservoir; and a second member coupled to the first member, at least the first member provided to prevent foam from flowing into an interior section of the compressor when a shaft of the compressor rotates, the second member controlling a position of the first member based on at least one condition, wherein the second member is coupled between the first member and a sub-frame member and wherein the sub-frame member is coupled to and located within the reservoir.

2. The foam control device of claim 1, wherein the at least one condition is an amount of oil in the reservoir.

3. The foam control device of claim 1, wherein the at least one condition is an environmental condition.

4. The foam control device of claim 1, wherein the at least one condition is a type of oil or refrigerant in the compressor.

5. The foam control device of claim 1, wherein the first member includes a plate having one or more apertures to allow oil suctioned from the reservoir to pass back into the reservoir.

6. The foam control device of claim 5, wherein said one or more apertures are arcuate in shape.

7. The foam control device of claim 6, wherein the one or more arcuate apertures are concentrically disposed at one or more predetermined angles.

8. The foam control device of claim 6, wherein a first arcuate aperture is larger than a second arcuate aperture aligned at a predetermined angle relative to a center of the first member.

9. The foam control device of claim 1, wherein the second member includes a spring.

10. The foam control device of claim 1, wherein the second member is formed from a stack of sheets coupled between two arms of the sub-frame member proximate the reservoir.

11. The foam control device of claim 1, wherein the first member is coupled to the shaft.

12. The foam control device of claim 1, wherein the compressor is a scroll compressor.

13. The foam control device of claim 1, wherein the sub-frame member includes a plurality of arm members symmetrically oriented relative to and projecting radially from the shaft, and wherein a plurality of second members are coupled between the first member and respective ones of the arm members within the reservoir.

14. The foam control device of claim 13, wherein each of the second members includes a spring.

15. The foam control device of claim 14, wherein a first end of the spring contacts a first protrusion extending from a surface of the first member and a second end of the spring is contacts a second protrusion extending from a surface of a corresponding one of the arm members.

16. The foam control device of claim 15, wherein the spring is held in place between the first and second protrusions solely as a result of compression forces generated by the spring.

17. The foam control device of claim 16, wherein the first end of the spring surrounds the first protrusion and the second end of the spring surrounds the second protrusion.

18. The foam control device of claim 14, wherein a compression force generated by the spring controls a distance between the first member and a respective one of the arm members.

19. The foam control device of claim 13, wherein each arm member has a distal end that includes an upper member spaced a predetermined distance from a lower member, and wherein the second member is located between the upper member and the first member.

20. The foam control device of claim 1, wherein the second member controls a separation distance between the first member and the frame member within the reservoir.

21. The foam control device of claim 1, wherein a separation distance between the first member and oil in the reservoir is varied by at least the second member based on the at least one condition.

22. The foam control device of claim 21, wherein the separation distance between the first member and the oil in the reservoir is varied by the second member based on a type of the oil in the reservoir.

23. The foam control device of claim 21, wherein the separation distance between the first member and the oil in the reservoir is varied by the second member based on an amount of the oil.

* * * * *